US006060821A

United States Patent [19]

Suzuki et al.

[11] Patent Number: 6,060,821

[45] Date of Patent: May 9, 2000

[54] HEATER EQUIPPED SPARK PLUG

[75] Inventors: Takahiro Suzuki; Yukihiko Ito, both of Nagoya, Japan

[73] Assignee: NGK Spark Plug Co., Ltd., Japan

[21] Appl. No.: 08/570,824

[22] Filed: Dec. 12, 1995

Related U.S. Application Data

[63] Continuation of application No. 08/222,950, Apr. 5, 1994, abandoned.

[30] Foreign Application Priority Data

Jun. 16, 1993 [JP] Japan ..... 5-168366

[51] Int. Cl.[7] ..... H01T 13/20; H01T 21/02; F02P 1/00

[52] U.S. Cl. ..... 313/141; 313/137; 313/143; 445/7; 123/169 EL; 123/169 PB

[58] Field of Search ..... 313/141, 137, 313/143, 119, 128, 135, 145; 445/7; 123/169 EL, 169 E, 169 P, 169 PA, 169 PB

[56] References Cited

U.S. PATENT DOCUMENTS

| | | | |
|---|---|---|---|
| 1,799,225 | 4/1931 | Gerdien et al. | 313/137 |
| 3,365,605 | 1/1968 | Linstedt | 313/143 |
| 3,680,538 | 8/1972 | Scherenberg | 123/169 PB |
| 4,267,483 | 5/1981 | Nakajima et al. | 313/141 |
| 4,914,344 | 4/1990 | Watanabe et al. | 313/141 |

FOREIGN PATENT DOCUMENTS

| | | |
|---|---|---|
| 0 452 645 | 10/1991 | Germany . |
| 42 37 444 | 5/1994 | Germany . |
| 54-164322 | 11/1979 | Japan . |
| 55-10239 | 1/1980 | Japan . |
| 2-98085 | 4/1990 | Japan . |
| 2278685 | 11/1990 | Japan . |
| 4-303584 | 10/1992 | Japan . |

*Primary Examiner*—Nimeshkumar D. Patel
*Assistant Examiner*—Mack Haynes
*Attorney, Agent, or Firm*—Evenson, McKeown, Edwards & Lenahan, P.L.L.C.

[57] ABSTRACT

A heater-equipped spark plug comprises an insulator having an insulator nose which holds thereon a center electrode in the vicinity of a free end of an axial bore, a lead wire arranged along a surface of the insulator, a heater formed on the insulator nose by baking a metal paste and connected to the lead wire; and a high softening-point glass layer covering and holding the heater in place with an alumina layer interposed between the high softening-point glass and the heater. Preferably, the alumina layer can have a thickness of 20–200 $\mu$m and the high softening-point glass layer can have a thickness of 30–500 $\mu$m.

7 Claims, 3 Drawing Sheets

HEATER EQUIPPED SPARK PLUG

This application is a continuation of application Ser. No. 08/222/950, filed on Apr. 5, 1994 now abandoned.

BACKGROUND OF THE INVENTION a) Field of the Invention

This invention relates to the structure of a spark plug, which is suitable for use in an internal combustion engine of an automotive vehicle or the like and has improved anti-fouling properties against the deposit of carbon on an insulator nose, especially at low temperatures.

b) Description of the Related Art

To prevent deposit of carbon on an insulator nose, especially at low temperatures when employed in an internal combustion engine of an automotive vehicle or the like, it has heretofore been the general practice to use a spark plug with a nichrome wire wound on and around an insulator nose which holds a center electrode in the vicinity of a free end of an axial bore. Because the nichrome wire is prone to oxidation and burning-up through its exposure to high-temperature combustion gas of a gas-fuel mixture, the spark plug is accompanied by the drawback that its service life is short. With a view to overcoming this drawback, spark plugs have been proposed, including a spark plug with a resistance heating pattern formed from a high m.p. (melting point) metallized ink on a surface of an insulator nose [Japanese Utility Model Laid-Open (Kokai) No. SHO 54-164322] as well as a spark plug formed by printing a resistance heating pattern layer with a high m.p. metallized ink of tungsten, molybdenum, platinum or the like on a surface of a green ceramic substrate of alumina or the like, forming an insulating covering layer by a ceramic sheet or paste of alumina or the like on the resistance heating pattern layer, winding the green ceramic substrate, which carries thereon the resistance heating pattern layer printed on its surface and covered by the insulating covering layer, on and around a nose of an insulator, and then simultaneously sintering the ceramic substrate and the resistance heating pattern layer together with the insulator to integrally bond the former to the nose of the latter [Japanese Utility Model Laid-Open (Kokai) No. SHO 55-10239].

These conventional spark plugs are however still accompanied by one or another drawback. In the case of Japanese Utility Model Laid-Open (Kokai) No. SHO 54-164322, the resistance heating pattern made from the high m.p. metallized ink is buried in the surface of the insulator nose. It is simple in structure but, as it is provided with almost no electrical insulation or only with incomplete electrical insulation for the protection of the heater itself, the electrical insulation easily fails during an operation of an internal combustion engine and a spark is hence produced between an associated center electrode and the resistance heating pattern formed from the high m.p. metallized ink and buried in the surface of the insulator nose. The spark plug therefore involves the drawback that the ignition of an air-fuel mixture may become insufficient.

In the case of Japanese Utility Model Laid-Open (Kokai) No. SHO 55-10239, on the other hand, with a view to fully ensuring protection and electrical insulation of the heater itself, the insulating covering layer is formed with the ceramic sheet or paste of alumina or the like on the resistance heating pattern layer after printing the resistance heating pattern layer on the ceramic substrate of alumina or the like with the high m.p. metallized ink of tungsten, molybdenum, platinum or the like. The insulating covering layer, which was made from the ceramic sheet or paste of alumina or the like and covers the resistance heating pattern printed on the ceramic substrate, is however susceptible to breakage due to increased combustion gas pressure produced in an associated combustion chamber as a result of the recent move toward high-performance internal combustion engines. The insulating covering layer can no longer maintain sufficient electrical insulation, leading likewise to the drawback that no full ignitability can be retained for an air-fuel mixture.

SUMMARY OF THE INVENTION

Accordingly, an object of the present invention is to overcome the above-described drawbacks of the conventional spark plugs and is to retain sufficient insulation for a ceramic heater adapted to prevent deposit of carbon at low temperatures and also to improve the productivity of such a ceramic heater.

In one aspect of the present invention, there is thus provided a heater-equipped spark plug comprising: an insulator having an insulator nose which holds a center electrode in the vicinity of a free end of an axial bore; a lead wire arranged along a surface of the insulator; a heater formed on the insulator nose by baking a metal paste and connected to the lead wire; and a high softening-point glass layer covering and holding the heater in place with an alumina layer interposed between the high softening-point glass and the heater. Preferably, the alumina layer may have a thickness of 20–200 $\mu$m while the high softening-point glass layer may have a thickness of 30–500 $\mu$m.

The heater and alumina layer have been formed, for example, by applying the metal paste and an alumina paste on a resin sheet, adhering the resin sheet on an unsintered green body corresponding to the insulator nose and then simultaneously sintering the metal paste and the alumina paste together with an unsintered green body corresponding to the insulator and including the first-mentioned unsintered green body. Desirably, the insulator nose may define a recess and the heater can be arranged in the recess.

Owing to the construction described above, the heater which has been formed by baking the metal paste is disposed on the insulator nose, which holds the center electrode in the vicinity of the free end of the axial bore, and is connected to the lead wire arranged along a surface of the insulator. Further, the heater is covered with the high softening-point glass and, preferably, the thickness of the covering layer of the high softening-point glass can range from 30 $\mu$m to 500 $\mu$m. This has made it possible to ensure sufficient voltage withstand performance, to prevent deposit of carbon on the insulator nose by heating the insulator nose with the heater while protecting the heater from damages by thermal shocks, and also to sufficiently prevent production of a spark between the center electrode and the heater arranged on the insulator nose owing to excellent electrical insulating properties of the high softening-point glass.

Further, as the heater arranged on the insulator nose is covered and held in place by the high softening-point glass with the alumina layer interposed therebetween, the alumina layer can prevent cut-off of the heater, which would otherwise occur as a result of a change in the resistance value of the heater under the migration effect that the metal component (Si) contained in the high softening-point glass is caused to melt out when silicon oxide ($SiO_2$) abundantly contained in the high softening-point glass is heated to a high temperature upon feeding of a current to the heater and is maintained in the heated state. By setting within 20–200

μm the thickness of the alumina layer held between the heater and the high softening-point glass, it is possible not only to prevent cut-off of the heater, which would otherwise occur under the migration effect, but also to improve the impact resistance of the alumina layer itself.

In addition, the heater and the alumina layer can be provided in a form integrally bonded with the insulator nose by forming, for example, printing on a resin sheet a heater-forming layer and an alumina paste layer with a metal paste and an alumina paste, adhering the resin sheet on an unsintered green body corresponding to the insulator nose and then simultaneously sintering the heater-forming layer and the alumina paste layer together with an unsintered green body corresponding to the insulator and including the first-mentioned unsintered green body. This fabrication process can improve the productivity of the heater-equipped spark plug according to the present invention despite its rather complex structure. Further, the arrangement of the heater in the recess can prevent the glass from flowing out so that the positioning of the heater can be facilitated.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENT

The first embodiment of the present invention will now be described with reference to FIG. 1 and FIG. 2.

Figure 1:
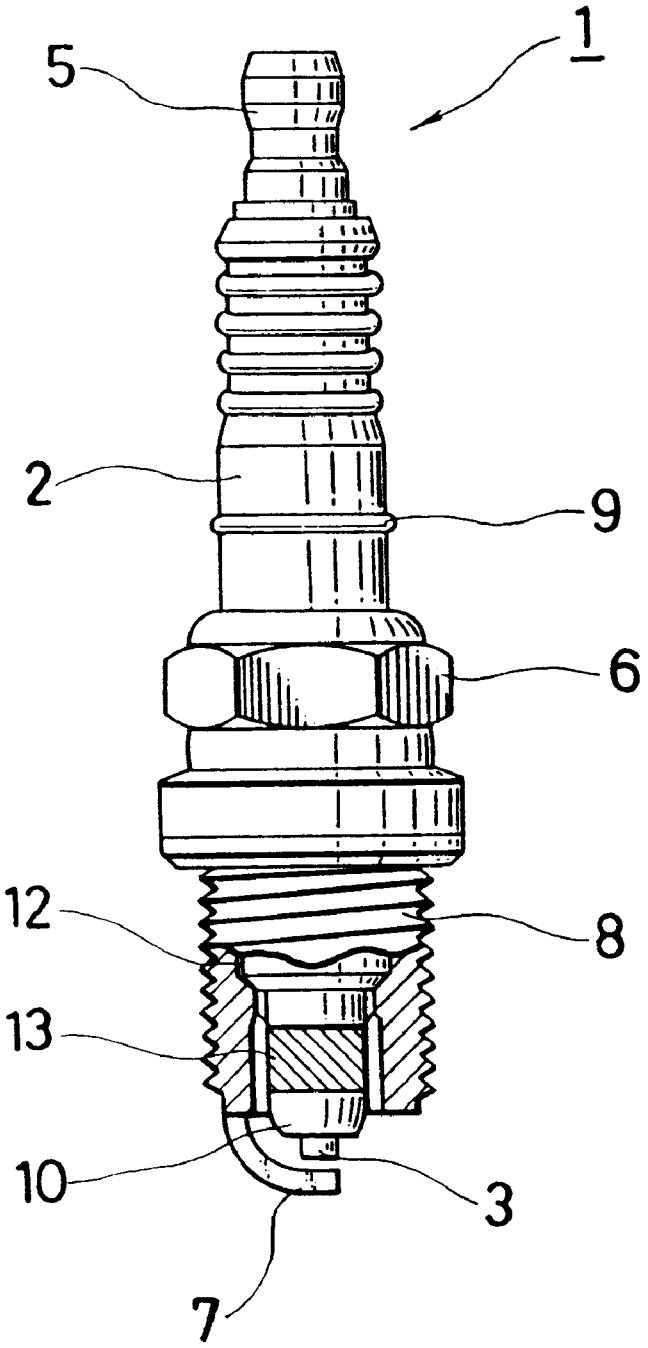
FIG. 1 is a partially cross-sectional front elevation of a heater-equipped spark plug according to a first embodiment of the present invention.

Referring first to FIG. 1, numeral 1 designates the heater-equipped spark plug according to the first embodiment of the present invention. This heater-equipped spark plug 1 is composed of an insulator 2, a center electrode 3 projecting from one end of the insulator 2, a terminal electrode 5 provided at an opposite end of the insulator 2 with a basal portion thereof fixedly sealed or otherwise held within an axial bore of the insulator 2, and a metal shell 6 having a ground electrode 7 at a free end thereof, that is, at a position opposite to a free end of the center electrode 3 and a threaded portion 8 adapted to threadedly fix the spark plug 1 in a plug hole upon mounting the spark plug 1 on an internal combustion engine.

Figure 2:
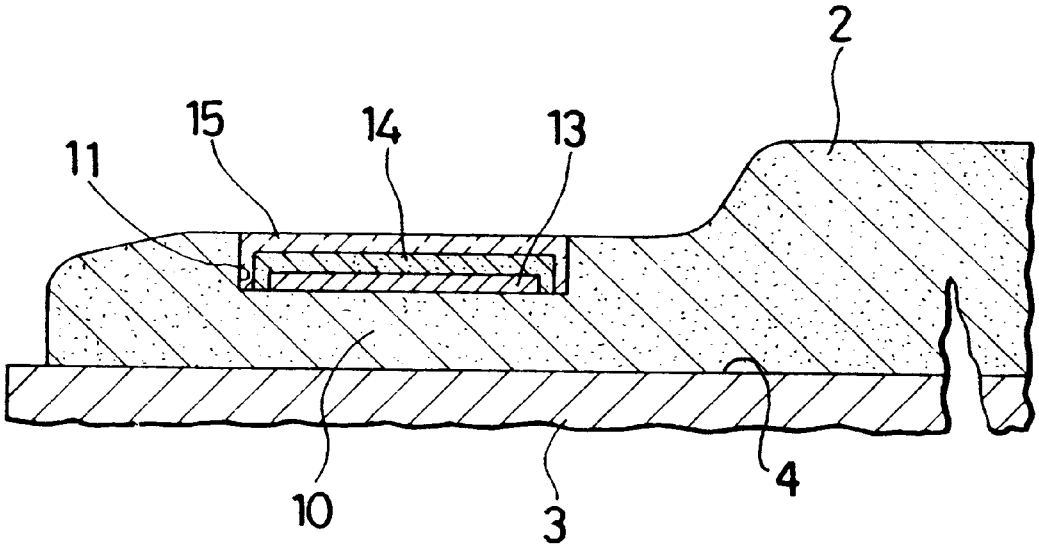
FIG. 2 is an enlarged fragmentary cross-sectional view of the heater-equipped spark plug of FIG. 1.
Figure 3:
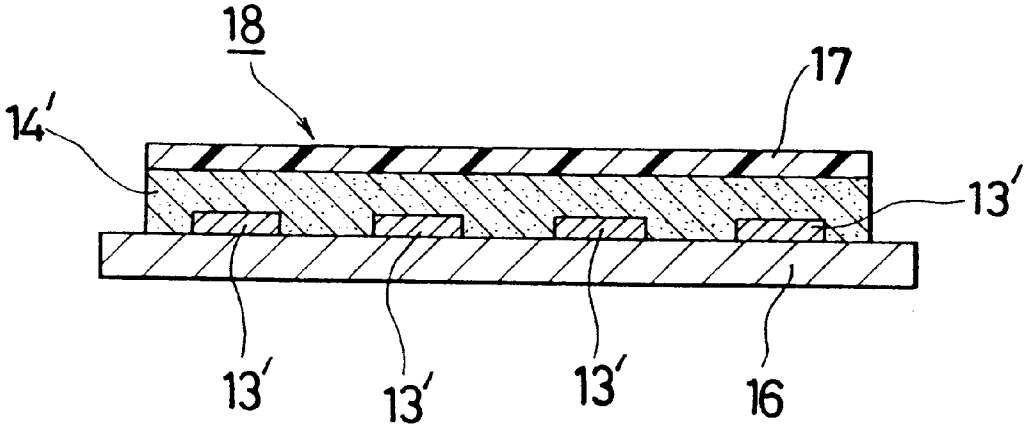
FIG. 3 is an enlarged cross-sectional view of heaters and the like printed in advance on a base paper sheet.

Reference is next had to FIG. 2. A recess 11 is formed in an insulator nose 10 of the insulator 2. This insulator nose 10 holds thereon the center electrode 3 in the vicinity of a free end of the axial bore 4. Arranged within the recess 11 is a heater 13 connected to a current-feeding ring 9 (see FIG. 1), which is disposed on an upper part of the insulator 2, via a lead wire 12 (also see FIG. 1) embedded along the surface of the insulator 2. This heater 13 has been formed, for example, by baking a metal paste of powder of a metal such as Pt or W, alumina powder and an acrylic or cellulose-base binder. It is to be noted that this baking should be conducted in a reducing atmosphere where W is used as the metal powder. The heater 13 arranged in the recess 11 is covered and held in place by a high softening-point glass layer 15 with an alumina layer 14 interposed therebetween. Preferably, the alumina layer 14 on the heater 13 can have a thickness in a range of 20–200 μm whereas the thickness of the high softening-point glass layer can range from 30 μm to 500 μm.

A description will next be made of a preferred example of a fabrication process of the heater-equipped spark plug 1 illustrated in FIG. 1 and FIG. 2. To form the heater 13 and alumina film 14 arranged in the recess 11 of the insulator nose 10, heater-forming layers 13' are printed in advance with a metal paste on one side of a base paper sheet 16 which has been coated on the same side with a water-soluble adhesive. These heater-forming layers 13' are next covered with an alumina paste layer 14', which will become the alumina layer 14, and a resin film 17, whereby a multilayered preform 18 is prepared. The multilayered preform 18 is then cut so that each piece so cut, namely, each single unit of the multilayered preform contains one of the heater-forming layers 13'. The base paper sheet 16 is peeled off with water from the multilayered preform unit, and the multilayered preform unit is adhered in a recessed portion of an unsintered green alumina body. It is to be noted that when sintered, this unsintered green alumina body and its recessed portion will become the insulator nose 10 and the recess 11, respectively. The multilayered preform unit 18, which no longer includes the base paper sheet 16, is then simultaneously sintered at about 1,600° C. together with an unsintered green alumina body which includes the first-mentioned unsintered green alumina body and when sintered, will become the insulator 2. The alumina layer 14 so formed is covered with high softening-point glass, which is an alumina-silica glass, and the high softening-point glass is finally glazed at about 1,350° C. to form the high softening-point glass layer 15.

As the first embodiment of the present invention is constructed as described above, the recess 11 is formed in the insulator nose 10 which holds the center electrode 3 in the vicinity of the free end of the axial bore 4. The heater 13 formed by baking the metal paste is arranged within the recess 11 and is connected to the lead wire 12 disposed along the surface of the insulator 2. The heater 13 is covered by the high softening-point glass layer 15, with the alumina layer 14 interposed therebetween. Preferably, the thickness of the high softening-point glass layer 15 can range from 30 μm to 500 μm. It is therefore possible to ensure sufficient voltage withstand performance and, while protecting the heater 13 from damages by thermal shocks, to sufficiently prevent deposit of carbon on the insulator nose 10 as a result of heating by the heater 13. Owing to the excellent electrical insulation by the high softening-point glass layer 15, it is also possible to sufficiently prevent production of a spark between the center electrode 3 and the heater 13 arranged within the recess 11 of the insulator nose 10. It is therefore feasible to achieve fail-free ignition of an air-fuel mixture in a combustion chamber of an internal combustion engine.

Further, as the heater 13 arranged within the recess 11 of the insulator nose 10 is covered and held in place by the high softening-point glass layer 15 with the alumina layer 14 interposed therebetween, the alumina layer 14 can prevent cut-off of the heater 13, which would otherwise occur as a result of a change in the resistance value of the heater 13 under the migration effect that the metal component (Si) contained in the high softening-point glass layer 15 is caused to melt out when silicon oxide ($SiO_2$) abundantly contained in the high softening-point glass layer 15 is heated to a high temperature upon feeding of a current to the heater 13 and is maintained in the heated state. By setting within 20–200 μm the thickness of the alumina layer 14 held between the heater 13 and the high softening-point glass layer 15, it is possible not only to prevent cut-off of the heater 13, which would otherwise occur by the migration effect developed in a high-temperature state as a result of feeding of a current to the heater 13, but also to improve the impact resistance of the alumina layer 14 itself.

In addition, the heater-forming layer 13' and the alumina paste layer 14', which will become the heater 13 and the alumina layer 14 upon being heated, can be formed by printing the heater-forming layers 13' with the metal paste on the base paper sheet 16, printing the alumina paste layer 14' over the metal paste layers 13' and overlaying the resin film 17 on the alumina paste layer 14'. The base paper sheet 16, the heater-forming layer 13' and the alumina paste layer 14' are integral with the resin film 17. This accordingly can facilitate to tightly adhere the multilayered preform 18, the heater-forming layer 13' and the alumina paste layer 14', which are integral with the resin film 17, in the recessed part of the unsintered green body, said recessed part and said unsintered green body corresponding to the recess 11 and the insulator nose 10, respectively, while peeling off the base paper sheet 16 with water. The heater-forming layer 13' and the alumina paste layer 14', which are still integral with the resin film 17, are then simultaneously sintered together with the unsintered green alumina body corresponding to the insulator 2, whereby the heater 13 and the alumina film 14 can be bonded integrally with the insulator nose 10. This fabrication process can facilitate the fabrication of the heater-equipped spark plug 1 according to the first embodiment of the present invention despite its rather complex structure and can also improve the productivity of the heater-equipped spark plug 1.

Figure 4:
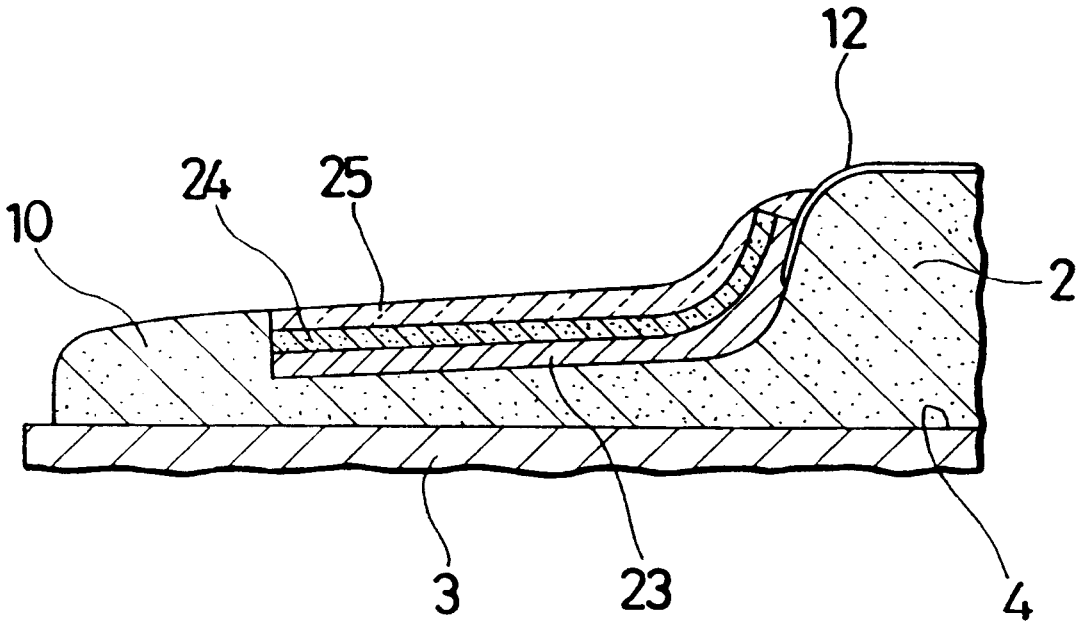
FIG. 4 is an enlarged fragmentary cross-sectional view of a heater-equipped spark plug according to a second embodiment of the present invention, in which no recess is formed in an insulator nose.

In the first embodiment described above, the heater 13 is arranged within the recess 11 formed beforehand in the nose 10 of the insulator 2. It is however to be noted that this recess 11 is not absolutely an essential element. As in the second embodiment depicted in FIG. 4, for example, a heater 23 can be arranged on the insulator nose 10 by using a stepped portion formed on a side of a basal portion of the insulator nose 10. This arrangement of the heater 23 facilitates the arrangement and connection of the lead wire 12. Incidentally, numerals 24 and 25 indicate an alumina film and a high softening-point glass layer, respectively, which correspond to the alumina film 14 and the high softening-point glass layer 15 in the first embodiment.

To compare the heater-equipped spark plug (Example C) according to the first embodiment of the present invention with comparative spark plugs similar to the heater-equipped spark plug except that the heater was provided with the alumina layer 14 alone (Comparative Example A) and with the high softening-point glass layer 15 alone (Comparative Example B), they were subjected to a real-car voltage withstand performance test in which the discharge voltage for each sample was set at 25 KV and also to an anti-migration test in which a change in the resistance value of each sample was measured after the sample was fed with a current (12 V/50 W) for 100 hours. The results are presented in Table 1 and Table 2. As will be envisaged clearly from these tables, it has been found that a heater-equipped spark plug having excellent voltage withstand performance and anti-migration performance can be obtained by covering and holding in place a heater, which is arranged in a recess of an insulator nose, with a high softening-point glass layer with an alumina layer interposed therebetween as in the first or second embodiment of the present invention.

TABLE 1

| | Thickness | Results |
|---|---|---|
| Comparative Example A (Alumina layer only) | 370 μm | Through-hole was formed in 5 hrs. |
| Comparative Example B (Glass layer only) | 400 μm | Remained good for 30 hrs. |
| Example C | | |
| (Alumina layer) | 100 μm | Remained good |
| (Glass layer) | 300 μm | for 30 hrs. |

TABLE 2

| | Thickness | Change in resistance after 100 hours |
|---|---|---|
| Comparative Example A (Alumina layer only) | 370 μm | −1% |
| Comparative Example B (Glass layer only) | 400 μm | −10% |
| Example C | | |
| (Alumina layer) | 100 μm | −1% |
| (Glass layer) | 300 μm | |

What is claimed is:

1. A heater-equipped spark plug comprising:

an insulator having an insulator nose which holds thereon a center electrode in the vicinity of a free end of an axial bore;

a lead wire arranged along a surface of said insulator;

means, formed on said insulator nose, for heating said insulator nose, said means comprising a resistive heat generating element connected to said lead wire; and a high softening-point glass layer covering and holding said heater in place with an alumina layer interposed between said high softening-point glass layer and said heater.

2. A heater-equipped spark plug according to claim 1, wherein said insulator nose contains a recess and said heat generating element is arranged in the recess.

3. A heater-equipped spark plug according to claim 1, wherein said alumina layer has a thickness of 20–200 μm and said high softening-point glass layer has a thickness of 30–500 μm.

4. A heater-equipped spark plug according to claim 3, wherein said insulator nose contains a recess and said heat generating element is arranged in the recess.

5. A heater-equipped spark plug according to claim 1, wherein said resistive heat generating element comprises a baked metal paste.

6. A heater-equipped spark plug according to claim 1, wherein said heat generating resistive element is connected to an electric current source, by means of said lead wire.

7. Method of manufacturing a heating unit for a spark plug of the type having an insulator having an insulator nose which holds thereon a center electrode in the vicinity of a free end of an axial bore, a lead wire arranged along a surface of said insulator, a heater formed on said insulator nose and comprising a baked metal paste, said heater being connected to said lead wire, and a high softening-point glass layer covering and holding said heater in place with an alumina layer interposed between said high softening-point glass layer and said heater, said method comprising the steps of:

applying a metal paste and an alumina paste on a resin sheet;

adhering said resin sheet on an unsintered green body which forms said insulator nose; and sintering the metal paste and alumina paste together with said unsintered green body.

* * * * *